United States Patent [19]

Bernstein et al.

[11] Patent Number: 4,797,684

[45] Date of Patent: Jan. 10, 1989

[54] WAVEGUIDE-FED MICROWAVE SYSTEM PARTICULARLY FOR CAVITY-BACKED SPIRAL ANTENNAS FOR THE KA BAND

[75] Inventors: Joel Bernstein, Petach Tikva; Samuel Spinner, Rishon Lezion, both of Israel

[73] Assignee: Elisra Electronic Systems Ltd., Benei Brak, Israel

[21] Appl. No.: 3,039

[22] Filed: Jan. 13, 1987

[30] Foreign Application Priority Data

Jan. 17, 1986 [IL] Israel ..... 77635

[51] Int. Cl.[4] ..... H01Q 1/36

[52] U.S. Cl. ..... 343/895; 343/772; 343/822

[58] Field of Search ..... 343/820, 822, 786, 895, 343/772

[56] References Cited

U.S. PATENT DOCUMENTS

| | | | |
|---|---|---|---|
| 3,441,937 | 4/1969 | Clasby et al. | 343/895 |
| 3,778,839 | 12/1973 | Kovar | 343/895 |
| 4,095,230 | 6/1978 | Salmond et al. | 343/895 |
| 4,370,659 | 1/1983 | Chu et al. | 343/772 |
| 4,609,888 | 9/1986 | Corzine et al. | 343/895 |

OTHER PUBLICATIONS

"The Spiral Antenna", Bowen, R., et al., International Convention Record, Alexandria, Va., 1960, pp. 84–95.

Thorvaldesen, T., "Spiral Antenna with Integrated Detector," Electronic Letters, vol. 16, NOR, pp. 484–486 (6/80).

Walton, K. L., et al, "Broadband Ridged Horn Design," Microwave Journal, vol. 7, pp. 96–101 (3/64).

Singh, D.R., et al. "Straightfoward Approach Produces Broadband Transitions," Microwaves and RF, pp 113–118 (9/84).

*Primary Examiner*—William L. Sikes
*Assistant Examiner*—Doris J. Johnson
*Attorney, Agent, or Firm*—Benjamin J. Barish

[57] ABSTRACT

A waveguide-fed microwave system particularly for cavity-backed spiral antennas for the Ka band comprises a waveguide transmission line; a microwave device having a pair of balanced, parallel feed wires; and a doubled tapered ridge transformer directly connecting the waveguide transmission line to the balanced, parallel feed wires of the microwave device providing a direct symmetrical transition between the waveguide transmission line and the microwave device.

18 Claims, 2 Drawing Sheets

WAVEGUIDE-FED MICROWAVE SYSTEM PARTICULARLY FOR CAVITY-BACKED SPIRAL ANTENNAS FOR THE KA BAND

BACKGROUND OF THE INVENTION

The present invention relates to a waveguide-fed microwave system designed particularly for the Ka band. The invention is especially useful in waveguide-fed cavity-backed spiral antenna systems and is therefore described below particularly with respect to this application.

The cavity-backed spiral antenna has been extensively used since its first introduction over 30 years ago. It is a two-dimensional structure fabricated by photoetching the spiral configuration on a copper-clad laminate. Of the wide variety of spiral shapes it may take, the three which have received widest attention are the logarithmic or equiangular spiral, the Archimedian spiral, and the rectangular counterpart of the Archimedian spiral. The antenna radiates a bi-directional circularly polarized beam normal to the plane of the printed elements when fed from a balanced two wire transmission line. Unidirectional patterns are obtained by mounting the spiral at the mouth of a cylindrical cavity. This type of antenna has been extensively described in the literature; see for example R. Bawer and J. J. Wolfe, "The Spiral Antenna, IRE National Convention Record, Part 1, pp. 84–95 (1960).

Improper excitation of the spiral antenna produces pattern dissymetry, called "boresight error" or "squint", wherein the electrical center of the antenna pattern, and the mechanical axis of symmetry, do not coincide. This is especially troublesome when the antenna is to be used in direction finding applications.

At the Ka band (26.4 to 40 GHz.), it is customary to use waveguide transmission lines. Cavity-backed spiral antennas, on the other hand, are customarily constructed using a coaxial transmission line and a balanced-to-unbalance transformer (balun) to connect to the spiral itself. The above-referenced Bawer and Wolf publication describes on pp. 88–89, some types of baluns which may be used, but points out that "boresight errors in the order of $15^0$ for some polarizations are not at all uncommon" (p. 89). The cavity-backed spiral antennas in use at the present time have reduced the "squint" to about $5^0$, which is about the best that can be achieved today because of the use of a balun.

Attempts have been made to further reduce the squint caused by baluns, or to eliminate the need of a balun; for example, see T. Thorvaldesen, "Spiral Antenna With Integrated Detector", Electronic Letters, Vol. 16, NOR, pp. 484–486 (June 5, 1980). This publication, after pointing out that much experimental effort has gone into the design of cavities that will damp out the unwanted modes produced in a balun-fed cavity-backed spiral antenna, proposes to eliminate the need for a balun by placing the detecting diode directly on the spiral itself. However, while putting the detector directly at the feed points of the antenna will improve the patterns as compared to connecting a balun to the feed, the problem is that after detection all frequency information is lost. Also lost, therefore, is much of the usefulness of the antenna, which is often used in connection with a frequency scanning receiver.

BRIEF SUMMARY OF THE INVENTION

An object of the present invention is to provide a waveguide-fed microwave system designed particularly for the Ka band, which eliminates the need for a balun and which produces a direct symmetrical transition between the waveguide and a microwave device having pair of balanced, parallel feed wires. A further object of the invention is to provide a squint-feed cavity-backed spiral antenna system in which the need for a balun is eliminated by an arrangement producing a direct symmetrical transition between the waveguide transmission line and the antenna.

According to a broad aspect of the present invention, there is provided a waveguide-fed microwave system designed particularly for the Ka band, comprising a waveguide transmission line; a microwave device having a pair of balanced, parallel feed wires separated by a dielectric; and a doubled tapered ridge transformer directly connecting the waveguide transmission line to the balanced, parallel feed wires of the microwave device. The double tapered-ridge transformer comprises a pair of ridges fixed at their outer edges to, and in electrical contact with, the inner face of the waveguide transmission line at its opposite sides in alignment with each other and forming a gap between the inner edges of said ridges, which gap is formed with a taper decreasing in width from the waveguide transmission line to the pair of balanced parallel feed wires, thereby providing a direct smooth, symmetrical transition between the waveguide transmission line and the microwave device.

According to a more specific aspect of the present invention, there is provided a squint-free antenna system designed particularly for the Ka band, comprising a cavity-backed spiral antenna having a pair of balanced, parallel feed wires separated by a dielectric; a waveguide transmission line; and a double tapered ridge transformer directly connecting the waveguide transmission line to the balanced parallel feed wires of the cavity-backed spiral antenna providing a direct symmetrical transition between the waveguide transmission line and the antenna.

While the above-described arrangement for producing the direct symmetrical transition is particularly useful in waveguide-fed spiral antennas, this arrangement could be used in other applications requiring balanced two wire feeds, for example in dipole antennas.

It might be mentioned at this point that ridges have previously been added to waveguides and flared sections of horns to increase their bandwith; see for example K. L. Walton, and V. C. Sundberg, "Broadband Ridged Horn Design", Microwave Journal, Vol. 7, pp. 96–101 (March 1964). However, the usual method of feeding a spiral antenna from a waveguide is first to transform the waveguide to a coaxial transmission line, as by the use of a conventional coax adapter or as described in this article, and then to retransform to the balanced parallel wires of the spiral antenna using one of the known baluns as described previously.

In this connection, reference also may be made to the article D. R. Singh and C. R. Seashore, "Straightforward Approach Produces Broadband Transitions," Microwaves and RF, pp. 113–118 (Sept. 1984) describing a procedure for designing mm-wave waveguide-to-microstrip transitions. The latter article describes the classic method of waveguide to microstrip transitions using a single ridged waveguide tapered section. However, as pointed out earlier, this technique still requires a balun to feed the spiral.

Further features, advantages and applications of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
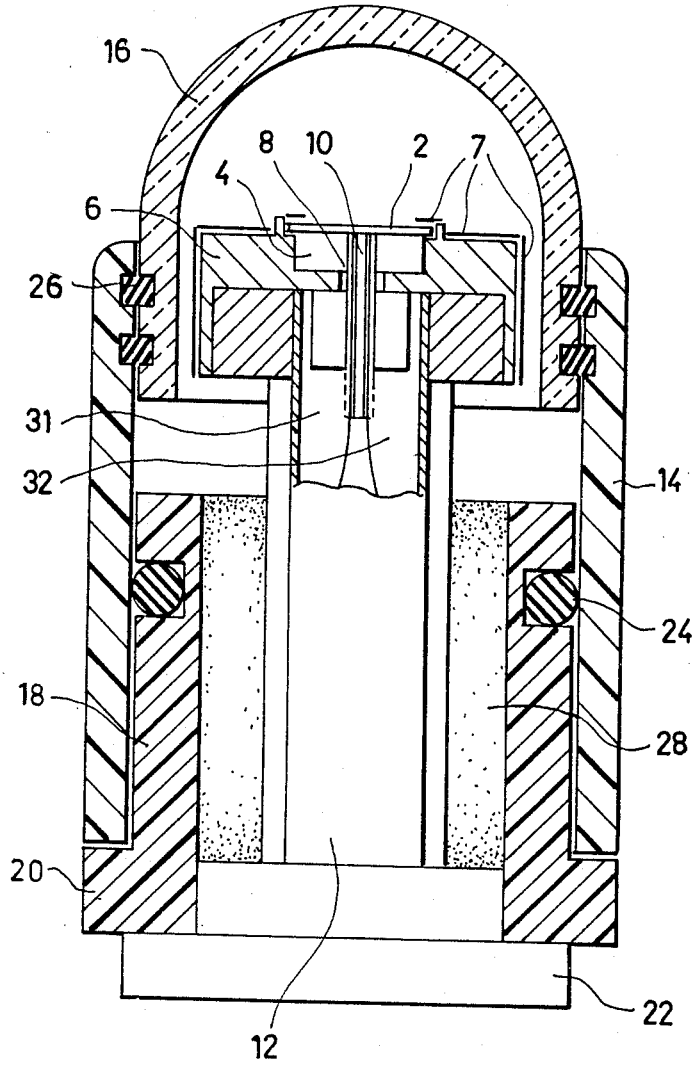
FIG. 1 is a longitudinal sectional view illustrating one form of cavity-backed spiral antenna constructed in accordance with the present invention.

The antenna system illustrated in FIG. 1 includes a spiral antenna 2 of conventional configuration printed on an insulating board mounted over the mouth of a cylindrical cavity 4 formed by a body 6. As known, the spiral antenna 2 further includes pattern control ferrites 7, in the form of coatings, to supress undesired surface currents. As also known, the spiral antenna 2 is fed by a pair of balanced, parallel feed wires 8 separated by a dielectric 10. The feed wires are connected at one end to the spiral arms of antenna 2 and pass through cavity 4 for connection to the transmission line, which in this case is a waveguide transmission line 12.

As indicated earlier, the cavity-backed spiral antennas now in use customarily first transform to the coaxial transmission line by using a waveguide-to-coax transformer, and then retransform from coax to the parallel feed wires of the spiral by the use of a balun (balance-to unbalance transformer). As distinguished from the known arrangements, the antenna system illustrated in FIGS. 1 and 2 includes a direct symmetrical transition between the waveguide ridges 12 and the balanced parallel feed wires 8 of the spiral antenna 2. This arrangement eliminates the need for a balun, and therefore avoids the production of "squint", which is characteristic of balun-fed spiral antennas as described above.

The spiral antenna 2, together with its connection to the waveguide transmission line 12, is enclosed by a radome comprising a sleeve 14 and a hemispherical cover 16 overlying the spiral antenna board 2. The antenna system further includes an adapter sleeve 18 formed at its outer end with an annular flange 20 engageable with an outer flange 22 in the waveguide transmission line 12. Adapter sleeve 18 is sealed with respect to radome sleeve 14 by an annular sealing ring 24, and to the radome cover 16 by an adhesive sealant 26. In addition, the space between the inner face of adapter sleeve 18 and the radome sleeve 14 is filled with an adhesive sealant 28.

Figure 2:
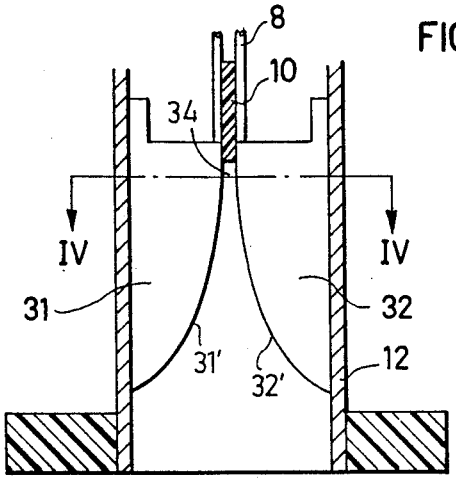
FIG. 2 is a sectional view illustrating the direct symmetrical transition between the waveguide transmission line and the spiral antenna in the antenna system of FIG. 1.

FIG. 2 illustrates the arrangement for directly connecting the waveguide transmission line 12 to the balanced parallel feed wires 8 of the spiral antenna 2 such as to eliminate the need for a balun, therefore avoiding the "squint" problem characteristic of antennas using baluns. Briefly, this arrangement includes a transformer having two tapered ridges 31, 32 directly connecting the waveguide transmission line 12 to the balanced feed wires 8, thereby providing a direct symmetrical transition between the waveguide and the antenna 2.

Figure 3:
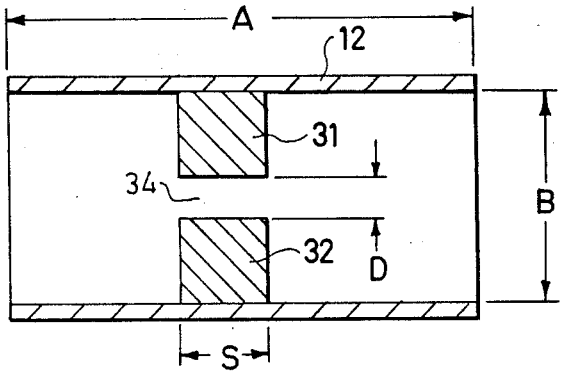
FIGS. 3 and 4 are diagrams illustrating the configuration of the waveguide and the double tapered-ridge transformer for providing the direct symmetrical transition between the waveguide and the antenna in the system of FIG. 1.
Figure 4:
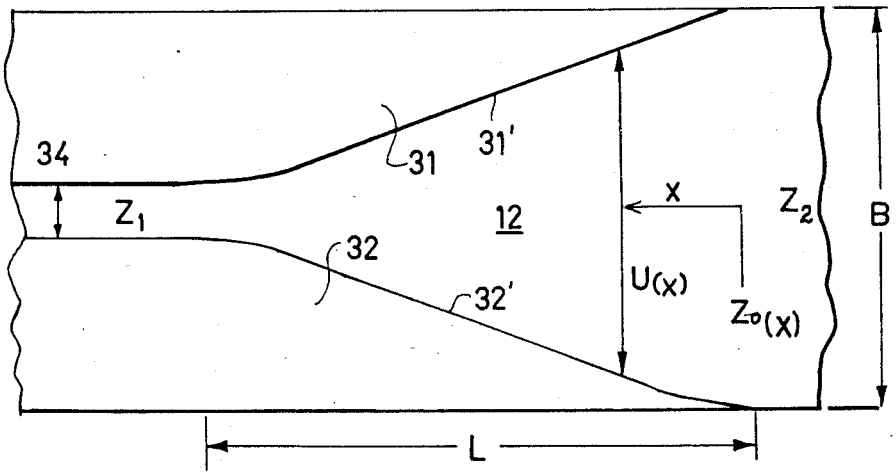

More particularly, the waveguide transmission line 12 is of rectangular configuration, as also shown in FIGS. 3 and 4. The two ridges, 31, 32 are fixed at their outer edges to, and in electrical contact with, the inner faces of the waveguide 12 at opposite sides thereof in alignment with each other, thereby producing a gap 34 between their inner edges. The inner edges of ridges 31, 32 are electrically connected, at one end, to the two balanced feed wires 8 leading to the spiral antenna 2. The inner edges of the two ridges 31, 32 are then formed with a taper preferably a cosine taper, as shown in 31', 32', respectively, to provide a smooth transition from the impedance of the waveguide transmission line 12 to the impedance of the two balanced feed wires 8.

A procedure for designing the two ridges 31, so as to define a gap with a cosine taper will now be described particularly with reference to FIGS. 3 and 4.

The synthesis program starts with the equations for the impedance of a ridged waveguide as a function of dimensions and frequencies. These equations are solved using a particular frequency at each point by means of successive approximations; the waveguide constraint is the assumed impedance taper.

The equation for the cutoff wavelength ($\lambda c$) for a $TE_{10}$ mode, is:

$$\frac{B}{D}\tan\theta_2 - \cot\theta_1 + \frac{B_e}{Yo_1} = 0 \tag{1}$$

where:

$$\theta_1 = \frac{360}{\lambda}\left(\frac{A-S}{2}\right)\text{degrees}$$

$$\theta_2 = \frac{360}{\lambda}\left(\frac{S}{2}\right)$$

$$\frac{B_e}{Yo_1} = \text{Discontinuity Susceptance}$$

A = the waveguide width,
B = the waveguide height,
S = the thickness of each tapered ridge 31, 32;
D = the minimum gap between the two tapered ridges;

$$Zo_\infty = \frac{1}{Yo_\infty} \tag{2}$$

where:

$$Yo_\infty = Z\sqrt{\frac{\epsilon_o}{\mu_o}}\ \frac{\lambda}{2\pi D}\left\{\frac{2D}{\lambda}\cos^2\left(\frac{\pi S}{\lambda}\right)\ln CSC\left(\frac{2\pi D}{2B}\right) + \frac{\pi S}{2\lambda} + \frac{1}{4}\sin\left(\frac{2\pi S}{\lambda}\right) + \left(\frac{D}{B}\right)\right.$$

-continued $$\left(\frac{\cos^2\left(\frac{\pi S}{\lambda}\right)}{\sin^2\left[\frac{\pi}{\lambda}(A-S)\right]}\right)\left[\frac{\pi(A-S)}{2\lambda} - \frac{1}{4}\sin\left(\frac{2\pi(A-S)}{\lambda}\right)\right]\Bigg\}$$

finally:

$$Zo = Zo_{\infty}/\sqrt{1-\left(\frac{F}{F}\right)^2} \quad (3)$$

where:

L is the length of the taper;

F is the designed frequency;

Fc is the cutoff frequency;

Zo is the characteristic impedance; and

Z is the characteristic impedance at infinity.

The constrains on the characteristic impedance (Zo) are (with reference to FIG. 4):

$$Zo(x) = \frac{(Z_1+Z_2)}{2} - \frac{(Z_2-Z_1)}{2}\cos\left(\frac{\pi X}{2}\right) \quad (4)$$

As one example, the impedance of the balanced parallel wires of the cavity-backed spiral antenna may be 183 ohms, and the impedance of the waveguide transmission line may be considerably higher, e.g. 450 ohms. The above described double tapered-ridges 31, 32 produce a smooth transition from the impedance of the waveguide transmission line to the impedance of the balanced antenna feed wires such that all squint is eliminated. In addition, the bandwith ratio of the direct symmetrical transition may be increased to approximately 10:1, substantially greater than the limit of 1.5:1 ratio of standard waveguide bands.

As indicated earlier, the above-described double tapered-ridge transition is particularly useful in waveguide-fed spiral antennas. However, this arrangement could be used to feed other devices requiring balanced to wire feeds, such as dipole antennas.

Many other variations, modifications and applications of the invention will be apparent.

What is claimed is:

1. A waveguide-fed microwave system designed particularly for the Ka band, comprising:

a waveguide transmission line;

a microwave device having a pair of balanced, parallel feed wires separated by a dielectric;

and a doubled-tapered ridge transformer directly connecting the waveguide transmission line to the balanced, parallel feed wires of the microwave device, said double tapered-ridge transformer comprising a pair of ridges fixed at their outer edges to, and in electrical contact with, the inner face of the waveguide transmission line at opposite sides thereof in alignment with each other and forming a gap between the inner edges of said ridges, said gap being formed with a taper which decreases in width from the waveguide transmission line to the pair of balanced, parallel feed wires, thereby providing a smooth, direct symmetrical transition between said waveguide transmission line and said microwave device.

2. The system according to claim 1, wherein said microwave device is an antenna.

3. The system according to claim 2, wherein said antenna is a cavity-backed spiral antenna.

4. The system according to claim 1, wherein said waveguide transmission line is a rectangular waveguide, and said double tapered-ridge transformer comprises a pair of ridges fixed at their outer edges to, and in electrical contact with, the inner face of the waveguide at opposite sides thereof in alignment with each other and forming a gap between the inner edges of said ridges, said inner edge being formed with a taper providing a smooth transition from the impedance of the waveguide transmission line to the impedance of balanced parallel wires of the microwave device.

5. A squint-free antenna system designed particularly for the Ka band, comprising:

a cavity-backed spiral antenna having a pair of balanced, parallel feed wires separated by a dielectric;

a waveguide transmission line;

and a double tapered ridge transformer directly connecting the waveguide transmission line to the balanced parallel feed wires of the cavity-backed spiral antenna, said double tapered-ridge transformer comprising a pair of ridges fixed at their outer edges to, and in electrical contact with, the inner face of the waveguide transmission line at opposite sides thereof in alignment with each other and forming a gap between the inner edges of said ridges, said gap being formed with a taper which decreases in width from the waveguide transmission line to the pair of balanced, parallel feed wires, thereby providing a direct symmetrical transition between said waveguide transmission line and said antenna.

6. The antenna system according to claim 5, wherein said waveguide transmission line is a rectangular waveguide, and said double tapered-ridge transformer comprises a pair of ridges fixed at their outer edges to, and in electrical contact with, the inner face of the waveguide at opposite sides thereof in alignment with each other and forming a gap between the inner edges of said ridges, said inner edges being formed with a taper providing a smooth transition from the impedance of the waveguide transmission line to the impedance of the balanced parallel wires of the cavity-backed spiral antenna.

7. The antenna system according to claim 6, wherein the impedance of the balanced parallel wires of the cavity-backed spiral antenna is 183 ohms, and the impedance of the waveguide transmission line is considerably higher.

8. The antenna system according to claim 6, wherein said pair of ridges have cosine tapers.

9. The antenna system according to claim 5, wherein said spiral antenna includes pattern control ferrites.

10. The antenna system according to claim 5, wherein said cavity-backed spiral antenna, said waveguide transmission line, and said double tapered-ridge transformer are all enclosed within a radome including a sleeve closed at one end by a hemispherical cover, which closed end is occupied by said spiral antenna.

11. The antenna system according to claim 10, further including an adapter sleeve received within the opposite end of said radome sleeve, and an annular sealing ring between said adapter sleeve and said radome sleeve.

12. The antenna system according to claim 11, further including an adhesive sealant between said waveguide transmission line and said adapter sleeve.

13. A squint-free antenna system designed particularly for the Ka band, comprising:

a cavity-backed spiral antenna designed for the Ka band and having a pair of balanced, parallel feed wires separated by a dielectric;

a waveguide transmission line also designed for the Ka band;

and a double tapered ridge transformer directly connecting the waveguide transmission line to the balanced parallel feed wires of the cavity-backed spiral antenna providing a direct symmetrical transition between said waveguide transmission line and said antenna;

said waveguide transmission line being a rectangular waveguide, and said double tapered-ridge transformer comprising a pair of ridges fixed at their outer edges to, and in electrical contact with, the inner face of the waveguide at opposite sides thereof in alignment with each other and forming a gap between the inner edges of said ridges, said gap being formed with a taper which decreases in width from the waveguide transmission line to the pair of balanced, parallel feed wires, thereby providing a smooth transition from the impedance of the waveguide transmission line to the impedance of the balanced parallel wires of the cavity-backed spiral antenna.

14. The antenna system according to claim 13, wherein the impedance of the balanced parallel wires of the cavity-backed spiral antenna is 183 ohms, and the impedance of the waveguide transmission line is considerably higher.

15. The antenna system according to claim 13, wherein said pair of ridges have cosine tapers.

16. The antenna system according to claim 13, wherein said spiral antenna includes pattern control ferrites.

17. The antenna system according to claim 13, wherein said cavity-backed spiral antenna, said waveguide transmission line, and said double tapered-ridge transformer are all enclosed within a radome including a sleeve closed at one end by a hemispherical cover, which closed end is occupied by said spiral antenna.

18. The antenna system according to claim 17, further including an adapter sleeve received within the opposite end of said radome sleeve, and an annular sealing ring between said adapter sleeve and said radome sleeve.

* * * * *